US006224195B1

(12) United States Patent
Maru et al.

(10) Patent No.: US 6,224,195 B1
(45) **Date of Patent: *May 1, 2001**

(54) RECORDING HEAD AND RECORDING APPARATUS USING THE SAME

(75) Inventors: Hiroyuki Maru, Atsugi; Masami Kasamoto, Ayase; Fumio Murooka, Atsugi; Yoshiyuki Imanaka; Masaaki Izumida, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/590,153

(22) Filed: Jan. 23, 1996

(30) Foreign Application Priority Data

Jan. 24, 1995 (JP) ..... 7-008896

(51) Int. Cl.[7] ..... B41J 2/05
(52) U.S. Cl. ..... 347/60
(58) Field of Search ..... 347/56, 60, 14, 347/19, 9, 50

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,608,577 | | 8/1986 | Hori | 346/140 R |
| 4,723,129 | | 2/1988 | Endo et al. | 346/1.1 |
| 4,740,796 | | 4/1988 | Endo et al. | 346/1.1 |
| 4,750,010 | * | 6/1988 | Ayers et al. | 346/107 R |
| 5,049,898 | * | 9/1991 | Arthur et al. | 347/19 |
| 5,081,474 | | 1/1992 | Shibata et al. | 346/140 R |
| 5,148,192 | | 9/1992 | Izumida et al. | 346/140 R |
| 5,179,389 | * | 1/1993 | Arai et al. | 347/14 |
| 5,191,357 | * | 3/1993 | Ono | 346/76 |
| 5,371,528 | | 12/1994 | Izumida et al. | 347/87 |
| 5,504,507 | * | 4/1996 | Watrobski et al. | 347/19 |
| 5,610,635 | | 3/1997 | Murray et al. | 347/7 |
| 5,673,069 | * | 9/1997 | Canfield et al. | 347/60 |

FOREIGN PATENT DOCUMENTS

| | | | |
|---|---|---|---|
| 2843064 | 4/1979 | (DE) . | |
| 0421806 | 10/1991 | (EP) . | |
| 54-51837 | 4/1979 | (JP) . | |
| 54-56847 | 5/1979 | (JP) . | |
| 59-123670 | 7/1984 | (JP) . | |
| 59-138461 | 8/1984 | (JP) . | |
| 60-71260 | 4/1985 | (JP) . | |
| 0 412 292 A2 * | 4/1990 | (JP) | 347/9 |

* cited by examiner

*Primary Examiner*—John Barlow
*Assistant Examiner*—Charles W. Stewart
(74) *Attorney, Agent, or Firm*—Fitzpatrick, Cella, Harper & Scinto

(57) ABSTRACT

A recording head records data by correcting a variation among recording elements without significantly increasing a size of a substrate of the recording head. The recording head includes a plurality of heat generating elements and a circuit for energizing the heat generating elements in accordance with record data to record data. Selection information for selecting one of a plurality of pre-heat pulse signals is non-volatilly stored in a ROM and one of the pre-heat signal pulses applied to an input terminal is selected in accordance with the selection information stored in the ROM to pre-heat the heat generating elements.

24 Claims, 12 Drawing Sheets

TRUTH TABLE OF INTERNAL CIRCUIT

| b,a | PRE-HEAT PULSE |
|---|---|
| 0,0 | 107a |
| 01 | 107b |
| 10 | 107c |
| 11 | 107d |

RECORDING HEAD AND RECORDING APPARATUS USING THE SAME

BACKGROUND OF THE INVENTION

1. Field of the Invention

The present invention relates to a recording apparatus having a heat generating element which is an electro-thermal transducer and a recording apparatus using the same.

2. Related Background Art

An ink jet recording method permits a high speed printing with a negligibly low noise generated during printing and permits recording by fixing on a plain paper without special treatment and hence it has been recently attracting notice.

Among others, an ink jet recording method disclosed in Japanese Patent Application Laid-Open No. 54-51837 or German Patent Laid-open (DOLS) 2843064 has a feature different from those of other ink jet recording method in that it acts a thermal energy to liquid to obtain a motive force to discharge liquid droplets. Namely, in the recording method disclosed in the above-mentioned case, the liquid which received the action of the thermal energy causes a status change with an abrupt volume increase and ink is discharged from an orifice at an end of an ink jet head to form flying liquid droplets. Those liquid droplets are deposited on a recording sheet to form a record.

In particular, the ink jet recording method disclosed in DOLS 2843064 is effectively applied to a so-called drop-on-demand recording method. Further, since a multi-orifice ink jet recording head of a high density full line type can be readily implemented, a high resolution and high quality image can be attained at a high speed.

The ink jet recording head of an apparatus used for this method includes a print head substrate which comprises a liquid discharge unit including an orifice provided to discharge liquid and a liquid flow path coupled to the orifice and having a thermal action unit by which a thermal energy for discharging liquid droplets is acted to the liquid, and an electro-thermal converter (heat generating element) as means for generating the thermal energy.

Recently, as the print head substrate of the above type, a substrate comprising a plurality of heat generating resistors arranged in a line, drivers provided one for each of the heat generating resistors for driving the heat generating resistors in accordance with image data, a shift register of the same number of bits as the number of the heat generating resistors for parallelly outputting the serially inputted image data to the respective drivers, and a latch circuit for temporarily storing the data outputted from the shift register, all mounted in one substrate, has been developed.

A circuit configuration of such a prior art print head substrate 400 is shown in FIG. 4.

Referring to FIG. 4, numeral 401 denotes heat generating elements arranged in a line, numeral 402 denotes a power transistor which functions as a driver, numeral 403 denotes a latch circuit and numeral 404 denotes a shift register. Numeral 405 denotes a terminal to which a clock signal for shifting data into the shift register 404 is applied and numeral 406 denotes a terminal to which serial image data is applied. Numeral 407 denotes an input terminal of a latch signal, numeral 408 denotes a heat pulse input terminal for externally controlling an on time of the power transistor 402, numeral 409 denotes a logic power supply terminal and numeral 410 denotes a ground terminal. Numeral 411 denotes a heat generating resistor driving power supply (VH) input terminal.

In a printer apparatus having a head including the print head substrate of the above configuration, the serial image data is serially inputted from the input terminal 406 to the shift register 404. The image data loaded to the shift register 404 is latched in the latch circuit 403 by the latch signal applied from the terminal 407. When a pulse is applied from the heat pulse input terminal 408, the power transistors 402 corresponding to the "1" image data are turned on. Thus, the corresponding heat generating resistors 401 are energized and the liquid (ink) in the liquid flow paths of the energized heat generating resistors 401 are heated and the ink is discharged from the discharge ports so that the printing is made.

Considering the energy necessary to generate bubbles in the liquid contacting to the heat generating resistor, if a heat dissipation condition is constant, the energy is a product of an energy required per unit area of the heat generating resistor and an area of the heat generating resistor. Thus, a voltage across the heat generating resistor, a current flowing through the heat generating resistor and a time (a pulse width) may be set to meet the above energy condition. In an actual use, the voltage may be set to be substantially constant by the power supply of the printer apparatus but as for the current, the resistance of the heat generating resistor may vary from rot to rot and from substrate to substrate due to variation of film thickness of the heat generating resistor during the manufacturing process of the substrate. Accordingly, when an applied pulse width is constant and the resistance of the heat generating resistor significantly is larger than the setting, the current is small and the applied energy is insufficient so that bubbles are not generated in the ink. On the other hand, when the resistance of the heat generating resistor is smaller and the current flowing through the heat generating resistor is larger than the setting, an excessive energy is applied and the heat generating resistor is baked and the lifetime of the heat generating resistor is shortened. To solve this problem, the resistance of the heat generating resistor 401 may be continuously monitored by a sensor 414 and the power supply voltage or the applied pulse width may be changed in accordance with the resistance so that a constant energy is applied.

Now, considering the amount of discharge of the liquid droplets, the amount of discharge primarily relates to a volume of bubbles of the ink. Since the bubble volume of the ink changes with a temperature of the heat generating resistor and a surrounding temperature, the temperature of the heat generating resistor and the surrounding temperature may be adjusted by a pulse width and a timing of a pulse (pre-heat pulse) of an energy of not discharging the ink applied prior to the application of the heat pulse for discharging so that a constant amount of droplets is discharged to maintain a print quality.

In accordance with the prior art, the compensation of the variation of the resistance of the heat generating resistor 401 and the control of the substrate temperature are conducted by feeding back the signals from the sensors 414 and 415 for monitoring the respective values to change the width of the heat pulse applied to the heat generating resistor 401, the width of the pre-heat pulse and the timing thereof under the control of the printer apparatus to output the heat signal. However, the amount of discharge of the ink varies from nozzle to nozzle due to the variation of the area of the orifice opening during the manufacture and the variation of a film thickness of a protection film for the heat generating resistor 401, and it leads to an irregular density and a stripe of the print and hence the control of the amount of discharge for each nozzle or for every several nozzles is required. Further, as the number of nozzles of the ink jet head increases, when a plurality of print head substrates are serially connected to form a multi-nozzle ink jet head, a resistance of the heat generating resistor varies from substrate to substrate and the energies applied to the respective substrates must be made substantially equal by changing the heat pulse for discharging the ink for each substrate. When the head is constructed by a plurality of substrates, a difference of print density between substrates becomes prominent in addition to the area of the orifice and the correction of the amount of discharge for each nozzle in the substrate is more important than for the single substrate.

SUMMARY OF THE INVENTION

It is an object of the present invention to provide a recording head which corrects a variation of recording elements without increasing a size of a substrate of the recording head and a recording apparatus using the same.

It is another object of the present invention to provide a recording head which non-volatilly stores selection information for pre-heat in accordance with a characteristic of a recording element, and a recording apparatus using the same.

It is another object of the present invention to provide a recording head which stores selection information for a pre-heat pulse only one time and selects one of a plurality of pre-heat pulses subsequently outputted to pre-heat a heat generating element for recording, and a recording apparatus using the same.

In order to achieve the above objects, the recording head of the present invention having an energization means for driving a plurality of recording elements and a circuit for activating the energization means in accordance with record data, comprises an input terminal for receiving a plurality of pulse signals for pre-heating the recording elements, memory means for receiving and non-volatilly storing selection information for selecting one of the pulse signals applied to the input terminal, and drive means for selecting one of the pulse signals applied to the input terminal in accordance with the selection information stored in the memory means to pre-heat the recording elements.

Further, in order to achieve the above objects, the recording apparatus of the present invention for recording an image on a record sheet by energizing a recording head comprises a recording head including energization means for driving a plurality of recording elements, an input terminal for receiving a plurality of pulse signals for pre-heating the energization means, a memory for receiving and non-volatilly storing selection information for selecting one of the pulse signals applied to the input terminal, and application means for selecting one of the pulse signals applied to the input terminal in accordance with the selection information stored in the memory and applying the selected pulse signal; characteristic information memory means for recording characteristics of the recording elements of the recording head; means for selecting one of the selection information in accordance with the recording characteristics stored in the characteristic information memory means, and transferring and non-volatilly storing the selected selection information to the memory of the recording head; pre-energization means for outputting a plurality of pulse signals to the recording head prior to the recording to pre-heat the recording head; and recording activation means for activating the energization means in accordance with the image data after the pre-heating by the pre-energization means to record the image data.

In accordance with the present invention, the recording head comprises the energization means for driving the recording elements, the input terminal for receiving the pulse signals for pre-heating the energization means and the memory for receiving and non-volatilly storing the selection information for selecting one of the pulse signals applied to the input terminal, and selects one of the pulse signals applied to the input terminal in accordance with the selection information stored in the memory.

Further, in accordance with the present invention, the recording apparatus using the above recording head stores the recording characteristics of the recording elements of the recording head, determines the selection information in accordance with the stored characteristic information, transfers it to the recording head and non-volatilly stores it in the memory, outputs pulse signals prior to the recording to pre-heat the recording elements, and after the pre-heating, energizes the recording head in accordance with the image data to record it.

DETAILED DESCRIPTION OF THE PREFERRED EMBODIMENTS

The preferred embodiments of the present invention are now explained with reference to the drawings.

Figure 1:
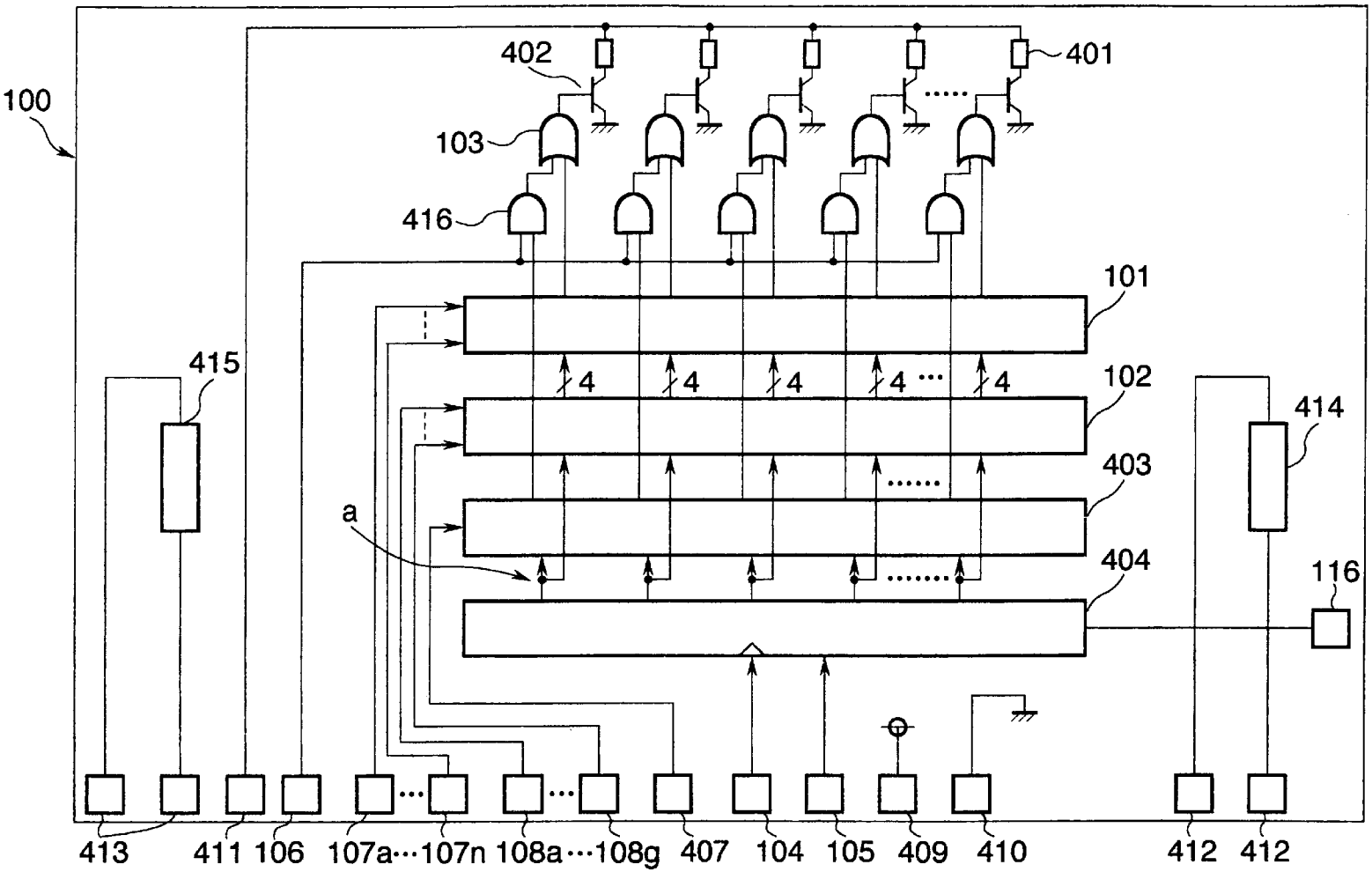
FIG. 1 shows a block diagram of a configuration of an ink jet recording head used in an ink jet recording apparatus of an embodiment.
Figure 4:
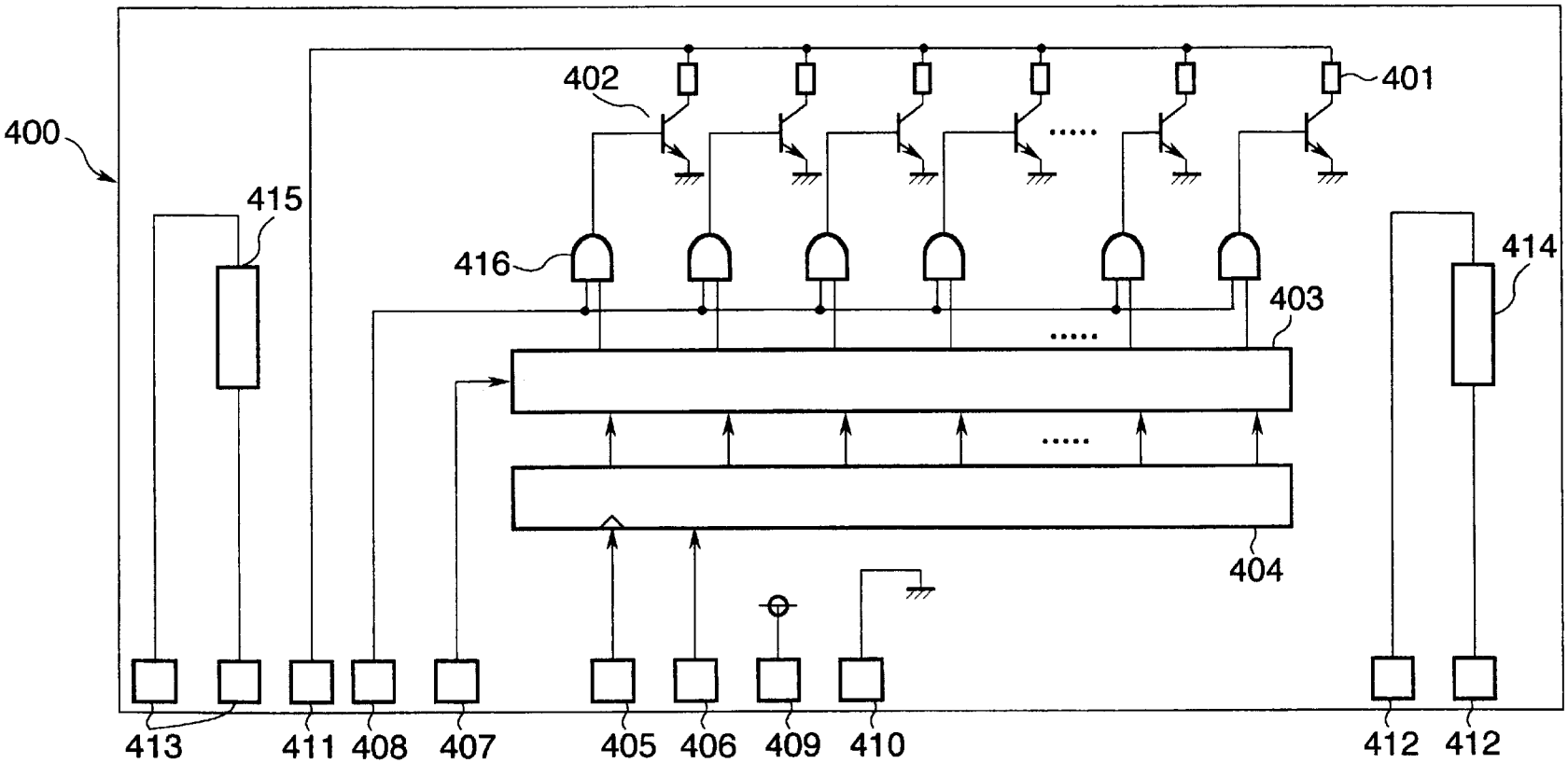
FIG. 4 shows a structure of a prior art recording head.

FIG. 1 shows a circuit diagram of a configuration of an ink jet print head substrate of one embodiment, in which elements common to a circuit diagram of prior art shown in FIG. 4 are designated by the like numerals.

In FIG. 1, numeral 100 denotes a recording head substrate, numeral 101 denotes a pre-heat pulse selection circuit for selecting a pre-heat width, numeral 102 denotes a memory (ROM) for storing selection data for selecting a pre-heat pulse to be described later with reference to FIGS.

6 and 7 and numeral 403 denotes a latch circuit for latching record data. Numeral 404 denotes a shift register which serially receives and holds the record data 105 in synchronism with a shift clock 104 or the selection data for the pre-heat pulse stored in the ROM 102. Numeral 407 denotes a latch signal of the record data supplied from a control unit of the ink jet recording apparatus of the embodiment.

Numeral 103 denotes an OR circuit which logically ORs a heat pulse outputted from an AND circuit 416 in accordance with the record data and a pre-heat pulse signal selected by the selection circuit 101 and outputted therefrom to output it to a driving transistor 402. As the output of the OR circuit 103 becomes high level, the corresponding driving transistor 402 is turned on and a current flows through the heat generating resistor 401 connected thereto to generate a heat.

Numerals 108*a* to 108*g* denote voltage signals from a high voltage power supply for storing the selection data into the ROM 102. Numeral 116 denotes a terminal to which data is shifted out from the shift register 404 and from which data is shifted out to a next substrate (for example, from a substrate 200-1 to a substrate 200-2 of FIG. 2).

An operation of the printer apparatus using the recording head described above is explained.

After a power supply of the apparatus is turned on, a pre-heat pulse width of each heat generating resistor is determined in accordance with the pre-measured ink discharge amount characteristic (the amount of ink discharge at a given temperature under the application of a predetermined pulse) from each discharge port (heat generating resistor) for each substrate. The selection data for selecting the pre-heat pulse width for each discharge port is transferred to the shift register 404 in synchronism with the shift clock 104. Then, the voltage signals 108*a* to 108*g* are outputted to store the selection data of the shift register 404 into the ROM 102. In actual pre-heating, one of the pre-heat signals 107*a* to 107*n* is selected in accordance with the corresponding data stored in the ROM 102 and the heat generating elements 401 is pre-heated accordingly. The ink discharge amount characteristic of each substrate may be stored in a memory on the substrate of the recording head or in a control unit of the printer apparatus.

In accordance with the recording head substrate of the present embodiment, a circuit scale of the pre-heat data ROM 102 and the pre-heat pulse selection circuit 101 may be reduced. As shown at a point a in FIG. 1, the output of the shift register 404 may be outputted to the record data holding latch circuit 403 and the pre-heat pulse width selection data holding ROM 102 so that the shift register 404 for receiving the image data is shared with the register for receiving the selection data for selecting the pre-heat pulse width and the register for receiving the selection data of the pre-heat pulse width may be omitted.

The holding of the selection data for determining the pre-heat pulse width need be conducted only once, for example, at the initial start of the printer apparatus. Accordingly, the transfer sequence of the print data to the recording head may be conducted in the same manner as that of the conventional manner even if the above function is provided.

The input of the pre-heat signals 107*a* to 107*n* after the holding of the selection data for selecting the pre-heat pulse width in the ROM 102 is explained. In the present embodiment, a plurality of pre-heat signals 107*a* to 107*n* for changing the ink discharge amount are provided.

First, the pulse width of the heat pulse is determined by feeding back the signal from the resistance sensor for monitoring the resistance of the heat generating resistor 401 to apply a proper energy to discharge the ink to the heat generating resistor 401 in accordance with the resistance. For the pre-heat pulse, the pulse widths and the timings of the pre-heat pulse signals 107*a* to 107*n* are determined by the printer control unit in accordance with the value of the temperature sensor 414. Thus, the pre-heat pulses are set such that the ink discharge amounts are constant for the respective nozzles in a given temperature condition.

By setting the width of the pre-heat pulse in accordance with a factor other than the temperature, that is, the amount of the ink discharge from each discharge port, the ink discharge amount may be made constant to eliminate the irregularity and stripe in the printed image. In this manner, by using the selection data for the pre-heat pulse width held in the ROM 102, one of the pre-heat signals 107*a* to 107*n* may be selected for printing.

By modifying the selection method for the pre-heat pulse width, the number of pre-heat pulses applied to the heat generating resistors 401 may be further increased.

Figure 6:
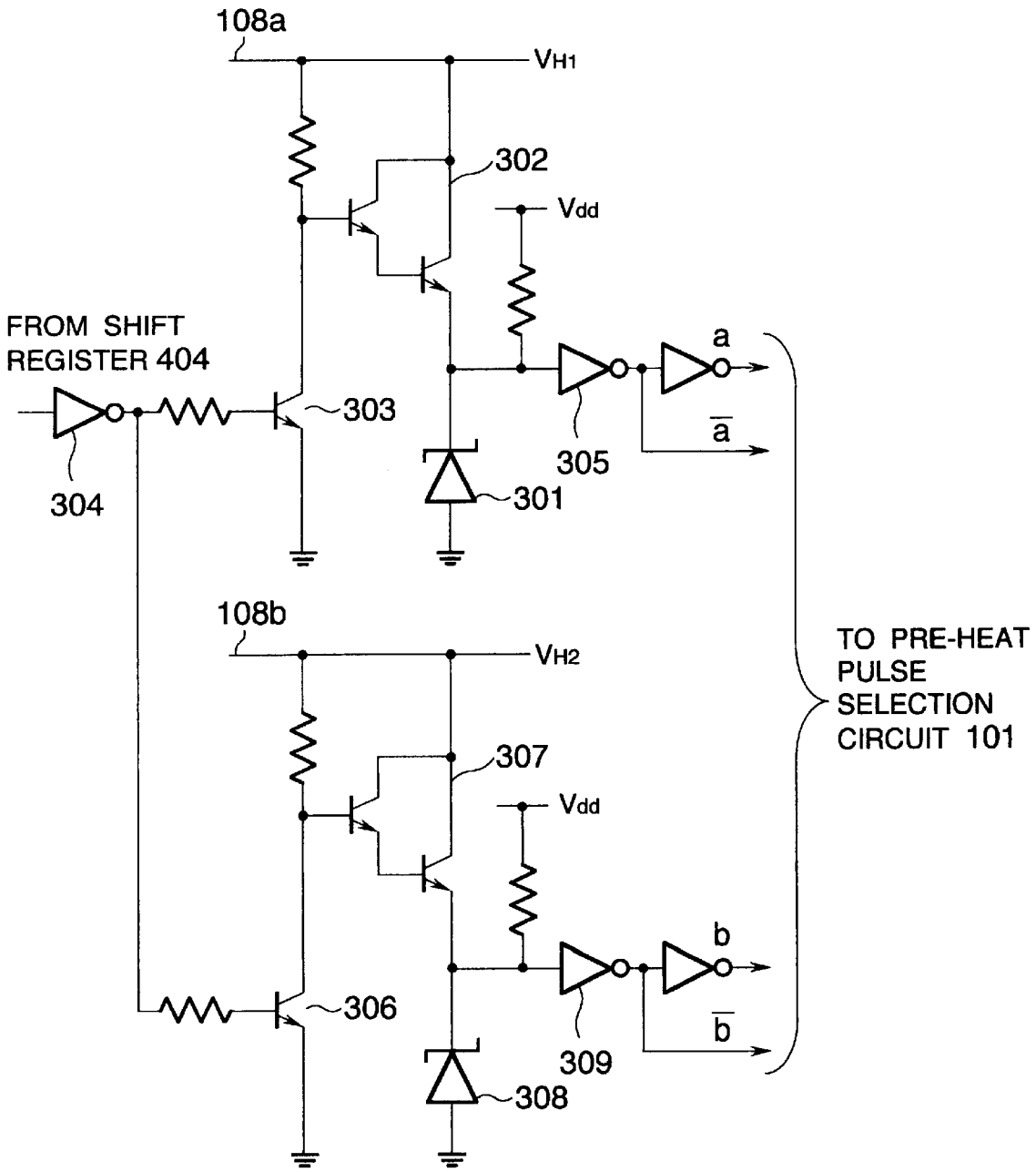
FIG. 6 shows a block diagram of a configuration of a data hold circuit of a memory (ROM) of the embodiment.

FIG. 6 shows a circuit configuration of the ROM 102 of the first embodiment of the present invention.

When the selection data is outputted from the shift register 404 and the data is applied to an inverter 304, transistors 303 and 306 are turned off if the data is at a high level and a current supplied from the high voltage supply 108*a* flows to a diode 301 through a Durlington transistor 302. As a result, the voltage applied to the diode 301 rises around a voltage of VH1 of the high voltage supply 108 and when it exceeds a reverse breakdown voltage of the diode 301, a large current starts to flow through a pn junction of the diode 301. An energy by a product of the voltage and the current produces a Joule heat which fuses aluminum of the pn junction to render the pn junction conductive (zener zapping) and the diode 301 is kept continuously conductive, that is, the input to the inverter 305 is continuously low level (the output a is low level) without regard to the data from the shift register 404.

On the other hand, when no voltage is applied to the voltage signal 108*b*, no current flows to the diode 308 through the Durlington transistor 307 and the diode 308 does not cause the zener zapping. In this case, the input to the inverter 309 is continuously high level and the output b is continuously high level.

When the data applied to the inverter 304 from the shift register 404 is low level, the transistor 303 is turned on and draws a current from VH1 to continuously turn off the Durlington transistor 302 so that the diode 301 does not cause the zener zapping. Accordingly, the input to the inverter 305 is continuously kept high level by a pull-up resistor.

Figures 8, 9:
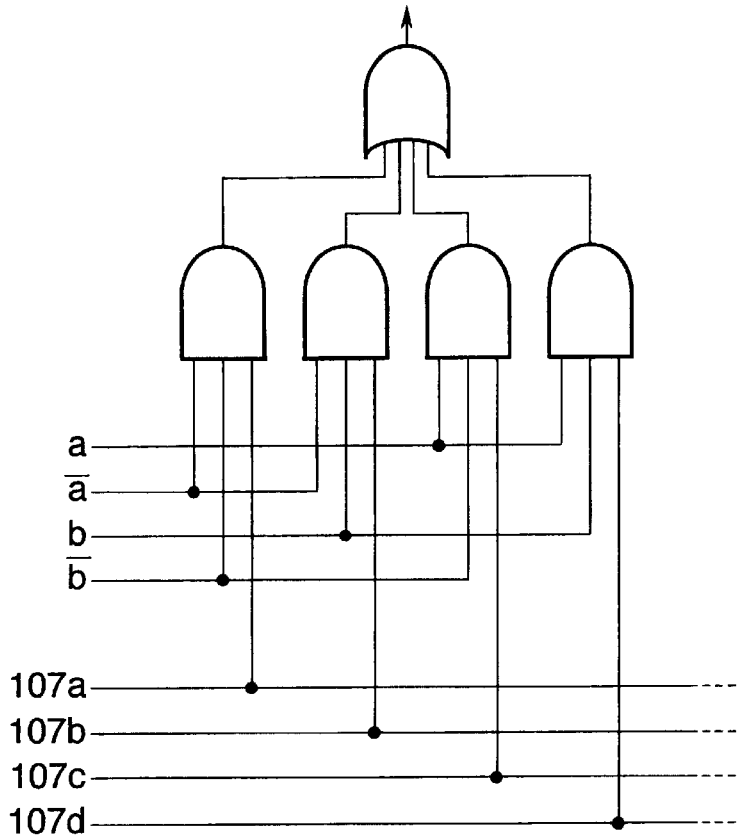
FIG. 8 shows a circuit for one heat generating element of a pre-heat selection circuit of the embodiment.
FIG. 9 shows truth data of a selection logic in the selection circuit of the embodiment.

FIG. 8 shows a circuit diagram of a configuration of a pre-heat selection logic corresponding to one of the heat generating elements 401 of the pre-heat selection circuit 101.

In FIG. 8, signals a and b and inverted signals of the signals a and b are outputted from the ROM 102 and the pre-heat signals 107*a* to 107*d* are externally supplied.

FIG. 9 shows truth data for selecting the pre-heat signal by the signals a and b and the inverted signals thereof, and the pre-heat signal is selected in accordance with such a selection logic. From the above description, the number of the high voltage signal lines is n/2 where n is the number of the pre-heat signals 107*a* to 107*n*.

In the present embodiment, the main heat input 106 and the pre-heat signals 107*a* to 107*n* for changing the ink discharge amount are separately provided. For the heat input 106, the resistance from the heat generating resistor monitor 414 is fed back and the heat signal of a pulse width having a proper energy to discharge the ink is applied in accordance with the resistance. For the pre-heat signal, the pulse width and the timing of each of the pre-heat signals 107*a* to 107*n* are changed in accordance with the value of the temperature sensor 415 and the pre-heat signals 107*a* to 107*n* are set to make the discharge amounts different in a given constant temperature condition, and one of the pre-heat signals is selected in accordance with the selection data stored in the ROM 102. As a result, the selection is made by a factor other than the temperature, that is, the discharge amount of each nozzle to make the ink discharge amount constant to eliminate the irregularity and the stripe of the record.

Figure 2:
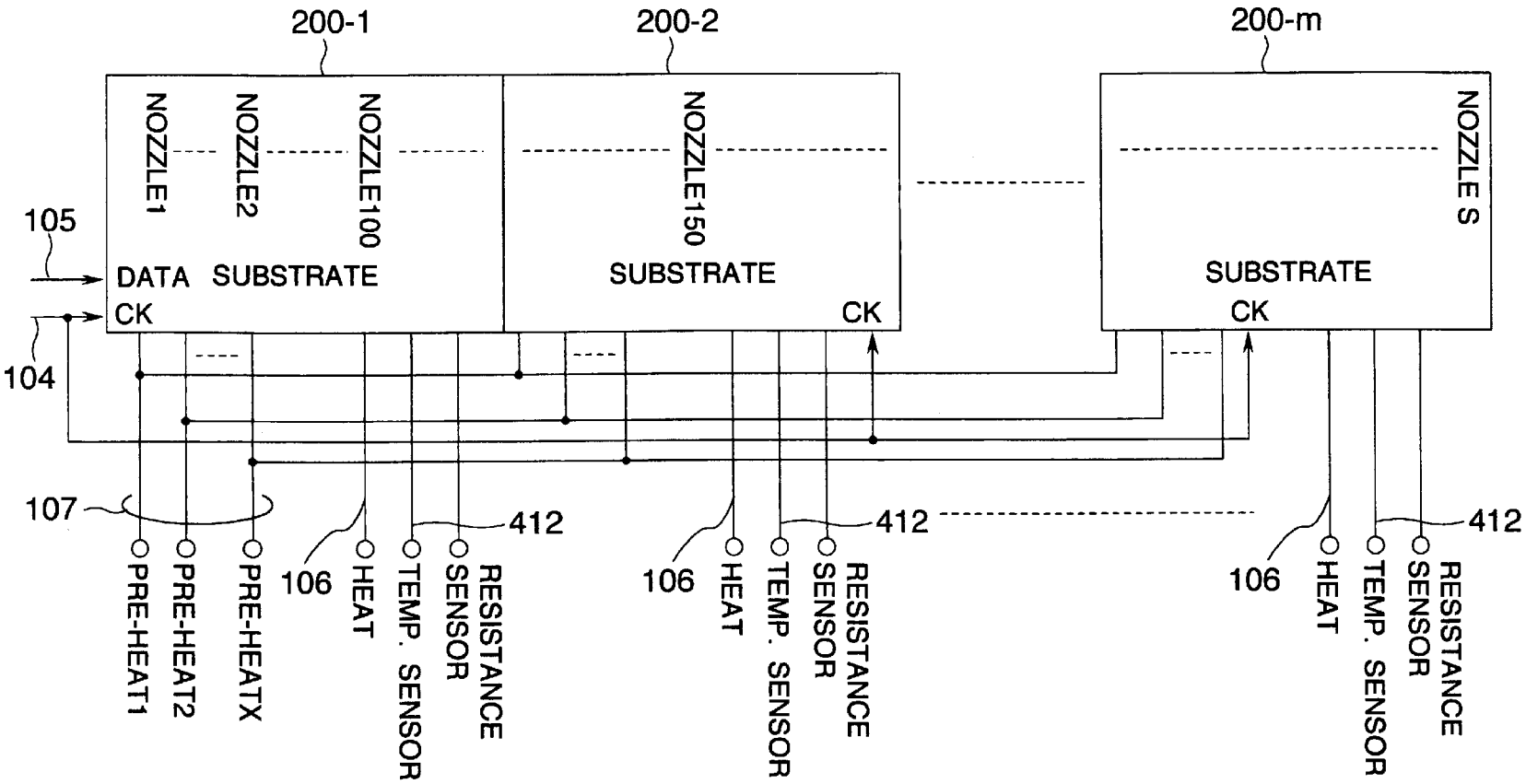
FIG. 2 shows a configuration of the ink jet recording head of the embodiment.

FIG. 2 shows a block diagram of a configuration of a multi-nozzle recording head IJH having a plurality of substrates arranged. In FIG. 2, the latch signal and the heat pulse signals of each substrate are omitted.

In FIG. 2, m substrates 200-1 to 200-m are used to attain a recording head having a total of s nozzles. An input terminal 105 of the substrate 200-2 is connected to a shift output terminal 116 of the substrate 200-1, and similarly the serial output terminal 116 of each substrate is connected to the serial input terminal 105.

The nozzles 1 and 100 of the substrate 200-1 are specifically explained.

Figure 3:
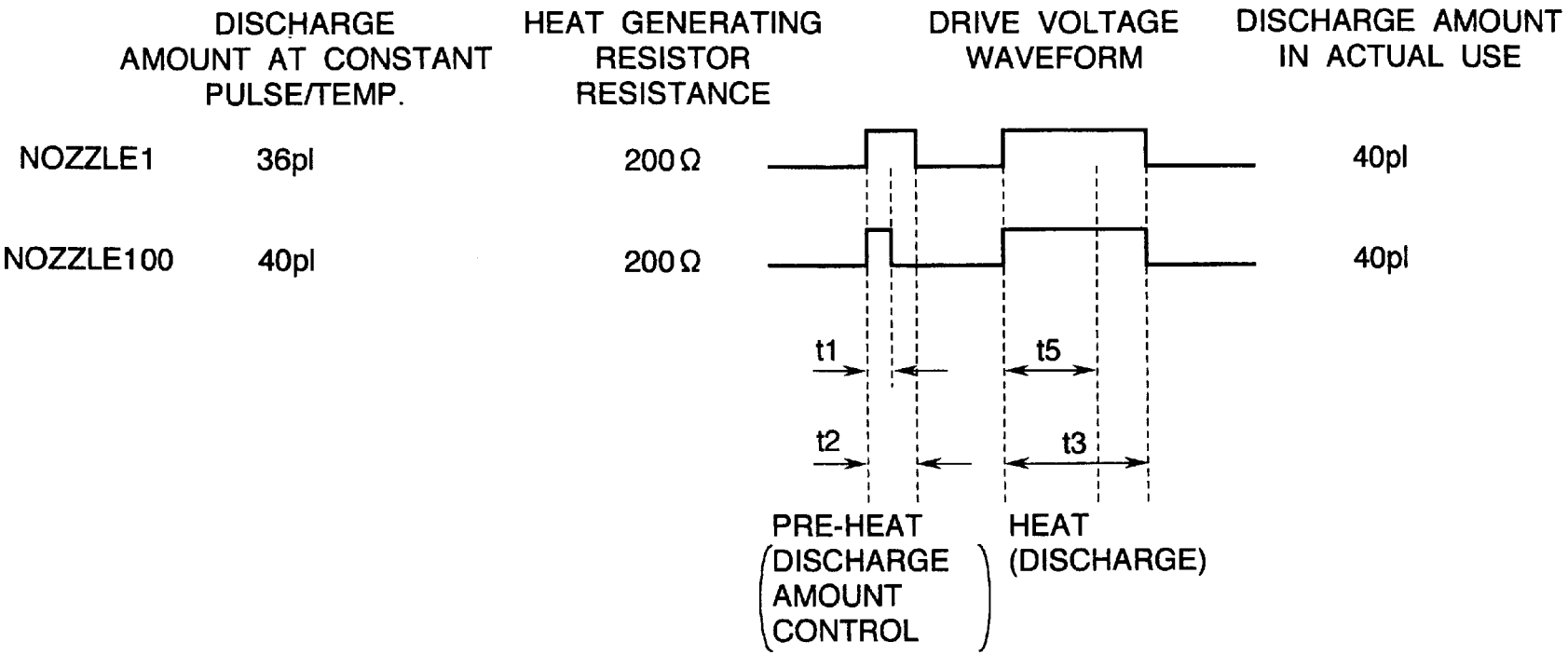
FIG. 3 shows an amount of ink discharge for a nozzle of the recording head of the embodiment, a pre-heat pulse and a heat pulse.

As shown in FIG. 3, it is assumed that the heat generating resistances of the nozzles 1 and 100 are 200Ω and the ink discharge amount of the nozzle 1 is 36 pl (pico litter) and the ink discharge amount of the nozzle 100 is 40 pl at a constant temperature and a constant pulse width. By setting the selection data for the nozzles 100 and 150 in the memory (ROM) 102 with the nozzle 100 being a reference, the pre-heat pulse width of the drive voltage waveform for the nozzle 1 having a smaller discharge amount is rendered longer. For the heat pulse, since it has been known by the resistance sensors 414 and 415 that the substrate 200-1 is 200Ω and the substrate 200-2 is 210Ω, the heat pulse width to be applied to the substrate 200-2 is set to be longer than that of the substrate 200-1 to drive the heat generating resistor 301 with the energies applied to the substrates 200-1 and 200-2 being substantially equal. A drive current waveform driven under this condition is shown in FIG. 3.

It is seen that the pre-heat pulse of the nozzle 1 having a smaller discharge amount is longer than that of the nozzle 100 ($t1<t2$), where $t5$ indicates a minimum power pulse width necessary to generate bubbles in the ink and cause the droplets to fly, and ($t1$, $t2<t5$) and ($t3>t5$) are met. During the drive, the pre-heat pulse changes within a range to meet ($t1<t2$) and ($t1$, $t2<t5$) for the temperature change of the substrate, and the actual drive discharge amount may be made to be continuously 40 pl for all nozzles so that a high quality print free from the irregularity and stripe is attained. At the same time, for the heat pulse having a larger applied power, the pulse width is adjusted in accordance with the resistance of the substrate to keep the power constant without undue condition so that the lifetime of the apparatus may be extended.

Figure 5:
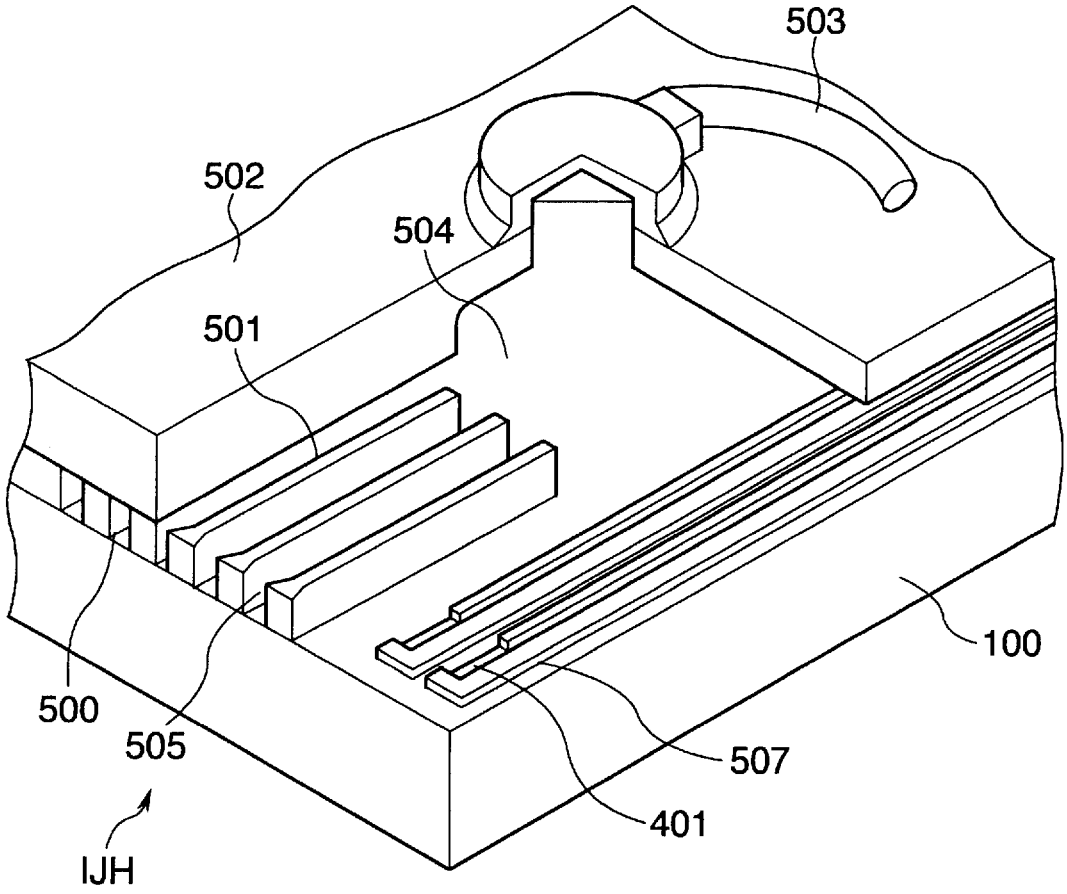
FIG. 5 shows a perspective view of major parts of the ink jet recording head of the embodiment.

FIG. 5 shows a construction of the substrate 100 of the recording head of the present embodiment. The like elements to those of FIG. 1 are designated by the like numerals.

In FIG. 5, a flow path wall member 501 for forming a liquid path 505 connecting to a plurality of discharge ports 500 and a top plate 502 having an ink supply port 503 are provided. The ink injected from the ink supply port 503 is stored in an internal common liquid chamber 504 and supplied to each liquid path 505. Under this condition, the heat generating resistor 401 of the substrate 100 is energized in accordance with the record data so that the ink is discharged from the discharge ports 500 and the record is made. Numeral 507 denotes a wiring.

[General Description of Apparatus]

Figure 10:
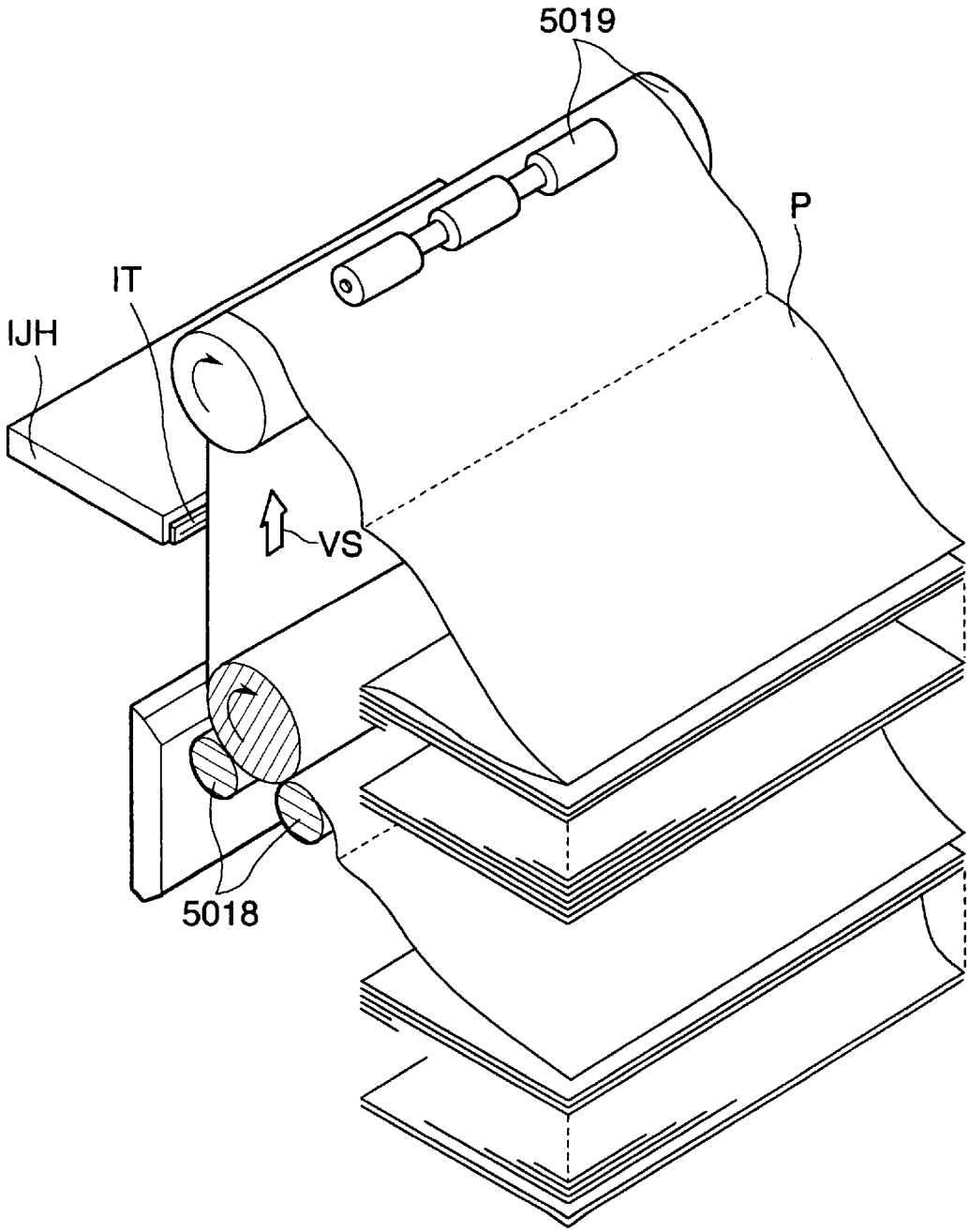
FIG. 10 shows a perspective view of a construction of the ink jet printer apparatus of the embodiment.

FIG. 10 shows an outer perspective view of a construction of major parts of an ink jet type printer IJRA which is a representative embodiment of the present invention. As shown in FIG. 10, the ink jet type printer of the present embodiment has a recording head (full-multi-recording head) IJH for discharging the ink jet over the entire width of a record sheet (continuous form) P arranged along a feed direction of the record sheet. The ink is discharged from the discharge ports IT of the recording head IJH toward the record sheet P at a predetermined timing.

In the present embodiment, the recording sheet P which is a fordable continuous sheet is fed in the direction VS as shown in FIG. 10 by driving a feed motor under the control of a control circuit to be described later so that an image is recorded on the record sheet. In FIG. 10, numeral 5018 denotes a sheet feed roller and numeral 5019 denotes an ejection roller which cooperates with the sheet feed roller 5018 to hold the record sheet P which is the continuous form at a record position and cooperates with the sheet feed roller 5018 driven by a drive motor (not shown) to feed the record sheet P along the direction VS.

Figure 11:
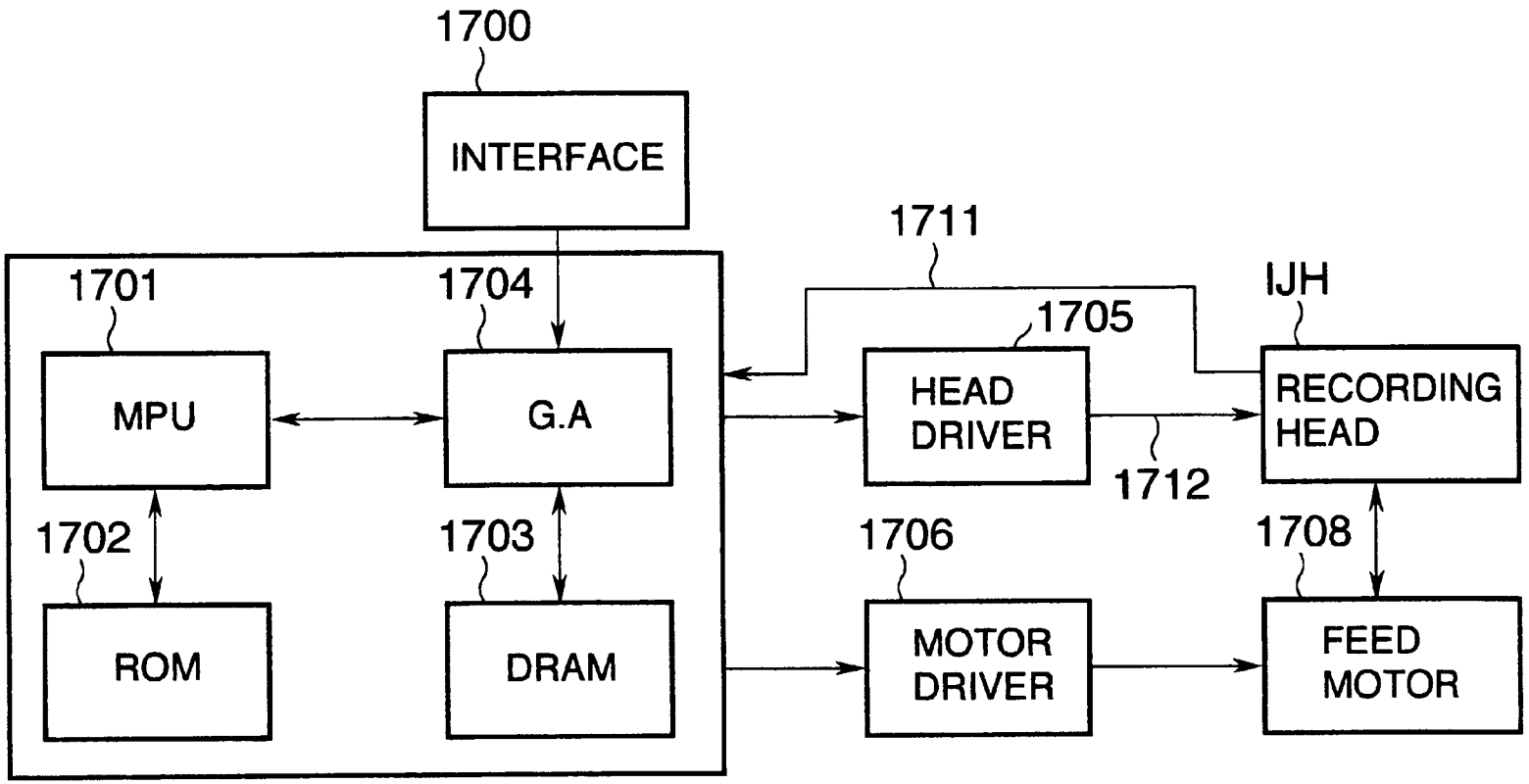
FIG. 11 shows a block diagram of a configuration of the ink jet printer apparatus of the embodiment.

FIG. 11 shows a block diagram of a configuration of the control circuit of the ink jet type printer.

In FIG. 11, numeral 1700 denotes an interface for receiving the record signal from an external equipment such as a host computer, numeral 1701 denotes an MPU, numeral 1702 denotes a ROM for storing a control program (including a character font as required) to be executed by the MPU 1701 and numeral 1703 denotes a DRAM for temporarily storing various data (such as the record data described above and the record data supplied to the head). Numeral 1704 denotes a gate array (GA) for controlling the supply of the record data to the recording head IJH and also controlling the data transfer between the interfaces 1701, the MPU 1701 and the RAM 1703. Numeral 1708 denotes a feed motor for feeding the record sheet (continuous form in the present embodiment). Numeral 1705 denotes a head driver for driving the recording head and numeral 1706 denotes a motor driver for driving the feed motor 1708.

An operation of the control circuit is explained. When the record signal is applied to the interface 1700, the record signal is converted to the printing record data between the gate array 1704 and the MPU 1701. The motor driver 1706 is driven and the head drive IJH is driven in accordance with the record data sent to the head driver 1705 to conduct the recording.

Numeral 1711 denotes a signal line for sending correction data from a memory (not shown) for storing variation correction data of the sensors of the respective substrates. Numeral 1712 denotes a signal line including the pre-heat pulse, the latch signal, the heat pulse and the high voltage signal. The MPU 1701 sends a control signal to the recording head IJH through a signal line 1712 such that each substrate forms uniform pixels in accordance with the correction data from a memory (for example, an EEPROM of the recording head) in the recording head IJH.

Figure 12:
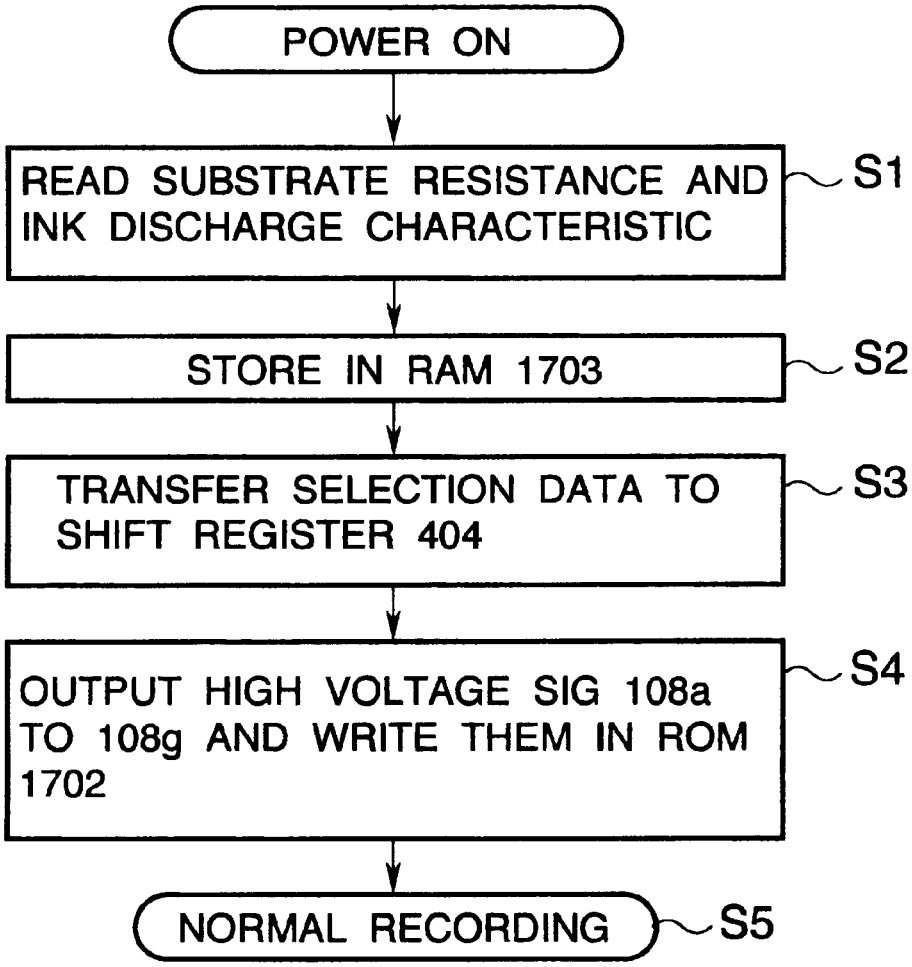
FIG. 12 shows a flow chart of a setting process of the selection data at power-on in the ink jet printer apparatus of the embodiment.

FIG. 12 shows a flow chart of a process at the power-on of the ink jet printer apparatus of the present embodiment. A control program for executing the process is stored in the ROM 1702 and it is executed under the control of the MPU 1701.

The process of FIG. 12 is started at the power-on of the apparatus. In a step S1, the resistances of the heat generating elements of the substrates (m substrates) of the recording head IJH and the ink discharge amount characteristics of the nozzles (discharge ports) of the respective substrates are read and they are stored in the DRAM 1703. The resistances of the heat generating elements are detected by the resistance sensors 414 and 415 and the nozzle ink discharge amount characteristics may be stored in the memory provided in each of the substrates 100 of the recording head. Then, in a step S3, the selection data is determined in accordance with the resistances of the heat generating resistors of the respective substrates and the ink discharge amount characteristics and it is serially transferred to the shift registers 404 of the respective substrates of the recording head. In a step S4, the high voltage signals 108*a* to 108*g* are outputted to write the selection data in the memory (ROM) 102. Thus, the selection data of the memory 102 is ready.

Figure 13:
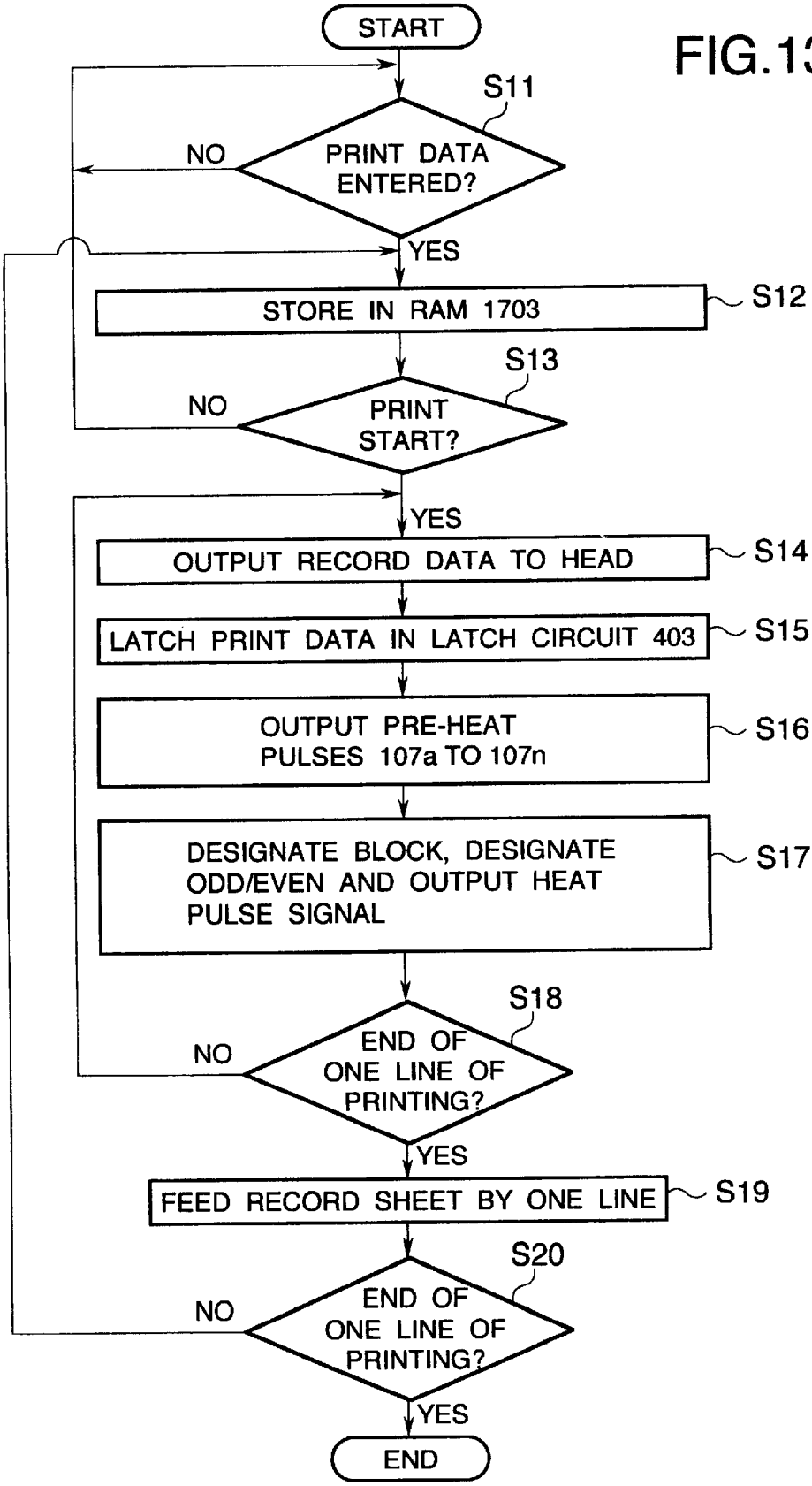
FIG. 13 shows a flow chart of a recording process in the ink jet printer apparatus of the embodiment.

FIG. 13 shows a flow chart of a print process in the ink jet printer of the present embodiment. A control program for executing the process is stored in the ROM 1702.

First, in a step S11, whether the print data has been inputted from an external equipment (host computer), not shown, through the interface 1700 or not is determined, and if the print data is inputted, the process proceeds to a step S12 to store the received print data in the RAM 1703. The process proceeds to a step S13 to determine whether one line of print data is ready or not, and if it is not ready, the process proceeds to a step S11, and if it is ready, the process proceeds to a step S14.

In the step S14, the print data to be recorded in the first column is serially transferred to the shift register 404. The process proceeds to a step S15 to output a latch signal 407 to latch the print data in the data latch circuit 403 of the substrate. The process proceeds to a step S16 to output the pre-heat pulse signals 107*a* to 107*n* so that the pre-heat signal is selected by the pre-heat selection circuit 101 in accordance with the selection data stored in the memory (ROM) 102 and it is outputted through the OR circuit 103.

[Another Embodiment]

Figure 7:
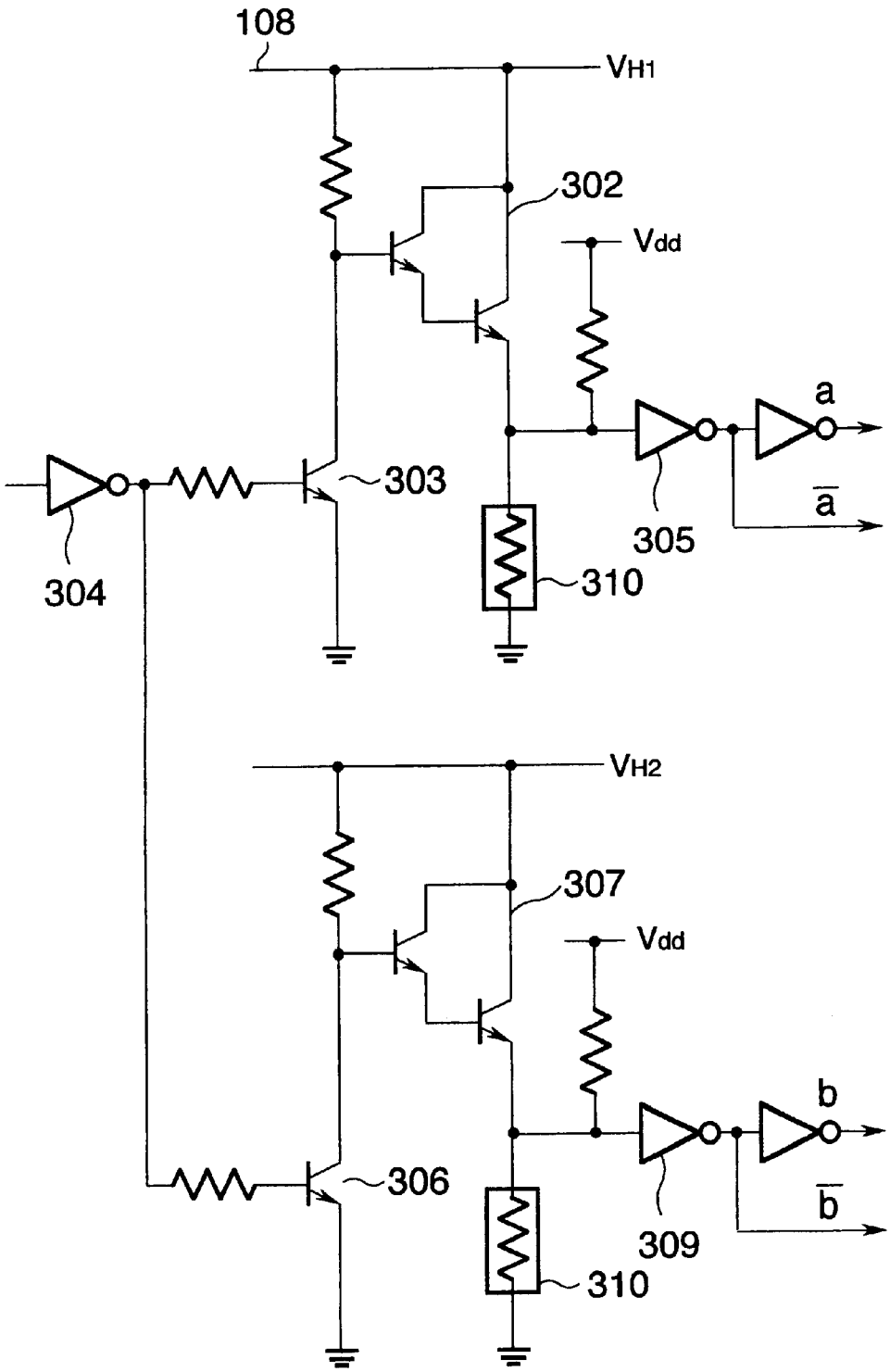
FIG. 7 shows a block diagram of a configuration of a data hold circuit of a memory (ROM) of another embodiment.

FIG. 7 shows a circuit diagram of a configuration of other embodiment of the memory (ROM) 102.

A difference from FIG. 6 resides in the use of a heat generating element 310 in place of the diode 301. In operation, when the selection data is transferred from the shift register 404, it is applied to the inverter 304. At this time, if the input data to the inverter 304 is high level, the transistor 303 is turned off and the current from the high voltage signal flows to the heat generation resistor 310 through the Durlington transistor 302. Thus, the voltage of the heat generating element 310 rises around the voltage of VH1 of the high voltage 108 and the current also increases by the resistance of the heat generating element so that a Joule heat is generated and the heat generating resistance is finally fused. Thus, the heat generating resistance 310 is kept non-conductive and the input to the inverter 305 is continuously kept high level by the pull-up resistor.

When the selection data applied to the inverter 304 is low level, the transistor 303 is turned on and draws a current from the voltage of VH1 of the high voltage signal 108 to continuously turn on the Durlington transistor 302. Thus, the heat generating resistor 310 is not fused. Accordingly, the heat generating resistor 310 is continuously conductive and the input to the inverter 305 is continuously kept low level.

It should be noted that the relation between the pull-up resistor to the voltage Vdd and the resistance of the heat generating element 310 is to meet (pull-up resistor)>(heat generating element resistance) and the heat generating element 310 is not fused by the current flowing from Vdd.

In accordance with the present embodiment, the heat pulse applied to discharge the ink and the pre-heat pulse for controlling the discharge amount (the surrounding temperature of the heat generating element) at the power which does not discharge the ink are independently applied through the separate input pads, and for the pre-heat pulse, a plurality of pre-heat pulses are applied to the respective pads to suppress the variation of the discharge amounts of the respective nozzles. The ink discharge amounts for the predetermined temperature for the respective nozzles are stored in the memory and a desired pulse is selected from the input pre-heat pulses in accordance with the stored discharge amounts and it is applied to the nozzles.

The memory in the substrate may be one in which a reverse bias is applied to a diode and the aluminum zapping is used or one in which an electrical energy is applied to the heat generating element to fuse it.

In the above description, the recording head substrate is applied to the ink jet type recording head although the present invention is not limited thereto. For example, it may be applied to a substrate for a thermal head. Further, while the embodiments are applied to the serial printer apparatus, the present invention may also be applied to a line type printer apparatus using a line type thermal head having a plurality of substrates or an ink jet head.

The present invention is particularly suitable for use in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat. Nos. 4,723,129 and 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through a discharge port to produce at least one droplet. The driving signal is preferably in the form of pulse because the development and the contraction of the bubbles can be effected instantaneously, and therefore the liquid (ink) is ejected with fast response.

The driving signal of the pulse type is preferably such as those disclosed in U.S. Pat. Nos. 4,463,359 and 4,345,262. In addition, the temperature rise rate of the heating surface is preferably such as those disclosed in U.S. Pat. No. 4,313,124 so as to achieve excellent recording.

The structure of the recording head may be those shown in U.S. Pat. Nos. 4,558,333 and 4,459,600 in which the heating portion is disposed at a bent portion, as well as the structure (linear or orthogonal liquid passage) of the combination of the ejection outlet, liquid passage and the electro-thermal transducer disclosed in the above-mentioned patents. In addition, the present invention is applicable to the structure disclosed in Japanese Patent Application Laid-Open No. 59-123670 in which a common slit is used as the discharge port for a plurality of electro-thermal transducers, and the structure disclosed in Japanese Patent Application Laid-Open No. 59-138461 in which an opening for absorbing a pressure wave of thermal energy is formed corresponding to the discharge port. Further, the present invention is applicable to a so-called full-line type recording head having a length corresponding to the maximum recording width. Such a recording head may comprise a single recording head formed as one unit or a combination head disclosed in the before-mentioned patents to cover the length.

In addition, the present invention is applicable to a replaceable chip type recording head which is connected electrically with the apparatus and can be supplied with the ink when it is mounted in the main assembly, or to a cartridge type recording head having an integral ink container.

The provision of the recovery means and/or the auxiliary means for the preliminary operation are preferable because they further stabilize the effects of the present invention. As for such means, there are capping means for the recording head, cleaning means therefor, pressing or sucking means, preliminary heating means which may be an electro-thermal transducer, an additional heating element or a combination thereof, also, means for effecting preliminary discharge may stabilize the recording operation.

Further, the present invention is effectively applicable to an apparatus having at least one of a monochromatic mode mainly with black, a multi-color mode with different color inks and/or full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable discharge in a conventional recording apparatus of this type, the ink may be such that it is liquid within the temperature range when the recording signal is applied. The present invention is applicable to other type of ink. In one of them, the temperature rise due to the thermal energy is positively prevented by consuming it for the state change of the ink from the solid state to the liquid state. Other ink is solidified when it is left, to prevent the evaporation of the ink. In any case, the application of the recording signal producing thermal energy, the ink is liquefied, and the liquefied ink may be discharged. Other ink may start to be solidified at the time when it reaches the recording sheet. The present invention is also applicable to the ink which is liquefied by the application of the thermal energy. Such ink may be retained in liquid state or solid state in holes or recesses formed in a porous sheet as disclosed in Japanese Patent Application Laid-Open No. 54-56847 and Japanese Patent Application Laid-Open No. 60-71260. The sheet is faced to the electro-thermal transducers. The most effective one of the inks described above is the film boiling system.

The present invention may be applied to a system comprising a plurality of equipments or an apparatus comprising one equipment. The present invention is also applicable to an application in which a program implementing the present invention is supplied to a system or an apparatus.

In accordance with the present invention, since the selection data may be read by effectively utilizing the data transferring shift register of the prior art, the increase of the space of the unit for receiving the selection data is prevented.

Further, the ink discharge amount of the respective nozzles can be precisely controlled.

In the head comprising a plurality of substrates, the power applied to each head may be kept constant.

Further, by setting the ink discharge amount from the nozzles in each substrate constant, the ink jet recording head for producing the record which is free from irregularity and stripe and the recording apparatus using the same are provided.

In accordance with the recording head of the embodiments, since the selection data is semi-permanently stored, the user may readily replace the data.

In accordance with the present invention, the variation of the respective recording elements can be compensated without significantly increasing the size of the substrate of the recording head.

In accordance with the present invention, the selection information to pre-heat in accordance with the characteristic of the recording element may be non-volatilly stored.

In accordance with the present invention, the heat generating element may be pre-heated and stored by storing the selection information of the pre-heat pulse only once and selecting one of the subsequently outputted pre-heat pulses.

What is claimed is:

1. A recording head provided with a substrate, said substrate comprising:

a plurality of recording elements driven in accordance with a drive data;

storing means for non-volatilely storing an information for controlling driving of the recording elements, said information being related to the driving of said recording elements; and control means for controlling, within the substrate, driving of the recording elements in accordance with the information non-volatilely stored in said storing means and the drive data.

2. A head according to claim 1, wherein said substrate further comprises converting means for converting serial date supplied to said substrate into parallel date which is supplied to said control means.

3. A head according to claim 1, wherein said storing means stores a characteristic of the head by fusing a part of a circuit by means of heat.

4. A head according to claim 1, wherein said storing means stores a characteristic of the head by applying a reverse bias greater than a breakdown voltage to a diodide and fusing/short-circuiting a metal portion at al contact point of diffusion layer and metal area of the diodide.

5. A head according to any one of Claims 1 to 4 wherein at least one said recording element is a heat generating element.

6. A head according to any one of claims 1 to 4, wherein said recording elements are heat generating elements and said recording head discharges ink from orifices by applying heat generated by said recording elements to ink in liquid flow paths coupled to the orifices corresponding to the heat generating elements.

7. A head according to claim 6, wherein a characteristic of the head is a characteristic for driving said recording elements.

8. A head according to any one of claims 1 to 4, further comprising an input terminal for receiving the record data, and wherein said recording elements, said input terminal, and said storing means are provided on a single board.

9. A head according to any one of claims 1 to 4, wherein a characteristic of the head is a characteristic for driving said recording elements.

10. A head according to claim 9, wherein the characteristic of the head is a drive condition of pre-heat signals which are applied to said respective recording elements.

11. A head according to claim 7, wherein the characteristic of the head is a drive condition of pre-heat signals which are applied to said respective recording elements.

12. A recording apparatus for driving a recording head to record on a recording medium, comprising:

a recording head provided with a substrate, said substrate comprising;

a plurality of recording elements driven in accordance with a drive data, storing means for non-volatilely storing an information for controlling driving of the recording elements, said information being related to the driving of said recording elements, and control means for controlling, within the substrate, driving of the recording elements in accordance with the information non-volatilely stored in said storing means; and supply means for supplying the driving data to said recording head.

13. A recording apparatus according to claim 12, wherein said substrate further comprises converting means for converting serial data supplied to said substrate into parallel data which is supplied to said control means.

14. A recording apparatus according to claim 12, wherein said storing means stores a characteristic of the head by fusing a part of a circuit by means of heat.

15. A recording apparatus according to claim 12, wherein said storing means stores a characteristic of the head by applying a reverse bias greater than a breakdown voltage to a diode and fusing/short-circuiting a metal portion at a contact point of diffusion layer and metal area of the diode.

16. A recording apparatus according to any one of claims 12 to 15, wherein at least one said recording element is a heat generating element.

17. A head recording apparatus according to any one of claims 12 to 15, further comprising an input terminal for receiving the record data, and wherein said recording elements, said input terminal and said storing means are provided on a single board.

18. A recording apparatus according to any one of claims 12 to 15, wherein said recording elements, said input terminal, said converting means and said storing means are provided on one board.

19. A recording apparatus according to any one of claims 12 to 15, wherein a characteristic of the head is a characteristic for driving said recording elements.

20. A recording apparatus according to claim 17, wherein a characteristic of the head is a characteristic for driving said recording elements.

21. A recording apparatus according to claim 19, wherein the characteristic of the head is a drive condition of pre-heat signals which are applied to said respective recording elements.

22. A head recording apparatus according to claim 20, wherein the characteristic of the head is a drive condition of pre-heat signals which are applied to said respective recording elements.

23. A head according to claim 1, further comprising receiving means for receiving the information externally of the substrate and providing the received information to said storing means, the receiving means also receiving the drive date externally of the substrate and providing the received drive data to said control means.

24. An apparatus according to claim 12 further comprising receiving means for receiving the information externally of the substrate and providing the received information to said storing means, the receiving means also receiving the drive data externally of the substrate and providing the received drive data to said control means.

* * * * *

UNITED STATES PATENT AND TRADEMARK OFFICE

CERTIFICATE OF CORRECTION

PATENT NO. : 6,224,195 B1
DATED : May 1, 2001
INVENTOR(S) : Hiroyuki Maru et al.

It is certified that error appears in the above-identified patent and that said Letters Patent is hereby corrected as shown below:

Title page,
Item [56], References Cited, FOREIGN PATENT DOCUMENTS:
"0 412 292 A2 * 4/1990 (JP)" should read -- 0 412 292 A2 * 2/1991 (JP) --; and
Item [57], ABSTRACT
Line 10, "non-volatilly" should read -- non-volatilely --.

Column 1,
Line 19, "method" should read -- methods --.

Column 2,
Line 24, "rot to rot" should read -- lot to lot --.

Column 3,
Line 20, "non-volatilly" should read -- non-volatilely --;
Line 37, "non-volatilly" should read -- non-volatilely --;
Line 50, "non-volatilly" should read -- non-volatilely --; and
Line 60, "non-volatilly" should read -- non-volatilely --.

Column 4,
Line 5, "non-volatilly" should read -- non-volatilely --; and
Line 15, "non-volatilly" should read -- non-volatilely --.

Column 8,
Line 18, "fordable" should read -- foldable --.

Column 12,
Line 19, "non-volatilly" should read -- non-volatilely --;
Line 39, "date" (both occurrences) should read -- data --;
Line 46, "diodide" should read -- diode --;
Line 47, "al" should read -- a --;
Line 48, "diodide." should read -- diode. --; and
Line 49, "Claims" should read -- claims --.

Column 13,
Line 10, "comprising;" should read -- comprising: --.

UNITED STATES PATENT AND TRADEMARK OFFICE

CERTIFICATE OF CORRECTION

PATENT NO. : 6,224,195 B1
DATED : May 1, 2001
INVENTOR(S) : Hiroyuki Maru et al.

It is certified that error appears in the above-identified patent and that said Letters Patent is hereby corrected as shown below:

Column 14,
Line 1, "head" should be deleted;
Line 20, "head" should be deleted;
Line 28, "date" should read -- data --; and
Line 30, "claim 12" should read -- claim 12, --.

Signed and Sealed this

Twenty-fifth Day of June, 2002

*Attest:*

*Attesting Officer*

JAMES E. ROGAN
*Director of the United States Patent and Trademark Office*